US010935015B2

(12) United States Patent
Koch et al.

(10) Patent No.: US 10,935,015 B2
(45) Date of Patent: Mar. 2, 2021

(54) DEVICE FOR DAMPING PRESSURE PULSATIONS FOR A COMPRESSOR OF A GASEOUS FLUID

(71) Applicant: Hanon Systems, Daejeon (KR)

(72) Inventors: Steffen Koch, Cologne (DE); Philipp Benjack, Kerpen (DE); Philip Gallisch, Vettweiß (DE)

(73) Assignee: Hanon Systems, Daejeon (KR)

( * ) Notice: Subject to any disclaimer, the term of this patent is extended or adjusted under 35 U.S.C. 154(b) by 52 days.

(21) Appl. No.: 16/278,942

(22) Filed: Feb. 19, 2019

(65) Prior Publication Data

US 2019/0257301 A1 Aug. 22, 2019

(30) Foreign Application Priority Data

Feb. 19, 2018 (DE) ..... 10 2018 103 610.8

(51) Int. Cl.
*F04B 39/00* (2006.01)
*F04B 39/12* (2006.01)

(52) U.S. Cl.
CPC ..... *F04B 39/0055* (2013.01); *F04B 39/12* (2013.01); *F04B 39/123* (2013.01)

(58) Field of Classification Search
CPC ..... F04B 39/0005; F04B 39/0055; F04B 39/0066; F04B 39/12; F04B 39/121;
(Continued)

(56) References Cited

U.S. PATENT DOCUMENTS 3,765,447 A * 10/1973 Cornell ..... F16K 3/243 137/538
6,206,663 B1 * 3/2001 Frenken ..... F04B 3/00 417/262

(Continued)

FOREIGN PATENT DOCUMENTS

CN 207261742 U 4/2018
JP 2008223757 A 9/2008

(Continued)

*Primary Examiner* — Patrick Hamo
*Assistant Examiner* — Joseph S. Herrmann
(74) *Attorney, Agent, or Firm* — Norton Rose Fulbright US LLP; James R. Crawford

(57) ABSTRACT

The invention relates to a device (1) for damping pressure pulsations for a compressor of a gaseous fluid, in particular of a refrigerant. The device comprises a housing (2), a piston element (6) as well as a spring element (8). The housing (2) is developed encompassing a chamber (3), with an inlet opening (4) and an outlet opening (5). The piston element (6), supported such that it is stayed across the spring element (8) on the housing (2), is disposed within the chamber (3) dividing the chamber (3) into a first chamber volume (3*a*) and a second chamber volume (3*b*), as well as being disposed movably in a direction of motion (11) between a first end position and a second end position. The motion of the piston element (6) effects a change of the chamber volumes (3*a*, 3*b*) and of a flow cross section of the outlet opening (5). The piston element (6) is developed as a hollow cylinder with two, at least partially closed, end faces (7, 13). The piston element (6) herein comprises at least one through-opening (14, 15) developed as a fluidic connection between a chamber volume (3*a*, 3*b*) and a volume encompassed by a wall of the piston element (6).

15 Claims, 3 Drawing Sheets

(58) Field of Classification Search
CPC .. F04B 39/122; F04B 39/123; F05B 2210/14; F05B 2260/964
See application file for complete search history.

(56) References Cited

U.S. PATENT DOCUMENTS

| | | | | |
|---|---|---|---|---|
| 6,257,848 | B1 * | 7/2001 | Terauchi | F04B 49/225 417/307 |
| 7,581,560 | B2 * | 9/2009 | Koch | F16K 15/026 137/543.19 |
| 7,648,346 | B2 * | 1/2010 | Murakami | F04B 49/225 417/222.2 |
| 7,918,656 | B2 * | 4/2011 | Hibino | F04B 27/1804 417/222.2 |
| 7,972,119 | B2 * | 7/2011 | Ozeki | F04B 27/1036 417/222.1 |
| 8,210,092 | B2 * | 7/2012 | Uchikado | F04B 27/0878 29/888.048 |
| 8,366,407 | B2 * | 2/2013 | Hayashi | F04B 27/08 417/222.2 |
| 2019/0257301 | A1 * | 8/2019 | Koch | F04B 39/12 |

FOREIGN PATENT DOCUMENTS

| | | | |
|---|---|---|---|
| KR | 19980073498 | A | 11/1998 |
| KR | 20150081785 | A | 7/2015 |
| KR | 20170028553 | A | 3/2017 |

* cited by examiner

DEVICE FOR DAMPING PRESSURE PULSATIONS FOR A COMPRESSOR OF A GASEOUS FLUID

This application claims priority from German Patent Application No, 10 2018 103 610.8 filed on Feb. 19, 2018, which is hereby incorporated herein by reference in its entirety.

FIELD OF THE INVENTION

The invention relates to a device for damping pressure pulsations for application in the compressor of a gaseous fluid, in particular of a refrigerant. The device comprises a housing, a piston element and a spring element. The housing is developed to encompass a chamber and comprises an inlet opening and an outlet opening. The piston element, supported such that it is stayed on the housing across the spring element, is disposed within the chamber dividing the chamber into a first chamber volume and a second chamber volume, and is as well disposed such that it is movable in a direction of motion between a first end position and a second end position. The motion of the piston element effects a change of the chamber volumes and of a flow cross section of the outlet opening.

BACKGROUND AND SUMMARY OF THE INVENTION

Compressors known in prior art for mobile applications, in particular for air conditioning systems of motor vehicles, for the purpose of conveying refrigerant through a refrigerant circulation, in the following also referred to as refrigerant compressors, are, independently of the refrigerant, often developed as piston compressors with variable stroke or variable stroke volume, also termed displacement, or as scroll compressors. Specifically in the case of refrigerant compressors driven by a belt and a belt pulley, the rotational speed is reached in response to the speed of the motor vehicle, in particular in response to the rotational speed of the drive motor. Piston compressors with variable stroke ensure the smooth and consistent operation of the air conditioning system since the compressor, independent of the rotational speed of the drive motor, has a requisite constant or variable capacity.

Conventional mechanical compressors are additionally developed with a device for damping pressure pulsations in order to reduce especially pressure pulsations which occur during operation of the compressor with low load, which means with a low mass flow to be conveyed. The function of the device for damping pressure pulsations comprises herein changing or adapting the cross section of a suction opening depending on the mass flow to be conveyed by the compressor. For example, with the device the diameter of an inlet of the suction opening is varied, in particular an abrupt change of the flow cross section is generated for the operation with low mass flow. The abrupt change of the flow cross section effects a rise of pressure pulsation loss which, in turn, reduces the pressure pulsation that is propagated through the refrigerant line of the refrigerant circulation into the interior of the vehicle and generates noise. However, for some applications the propagation loss is not sufficient.

U.S. Pat. No. 8,366,407 B2 discloses a device for reducing the pressure pulsation in the compressor of a refrigerant circuit with variable displacement. The device, developed as a damper element with varying volume, comprises a flow passage and a control valve.

The control valve includes a valve housing, a spool valve with a flow bore and with a damper chamber. The damper chamber is connected with the refrigerant circuit across the flow bore. The effective cross sectional area and the effective length of the flow bore are determined on the basis of the frequency of a specific pulsation of the refrigerant gas and of the volume of the damping chamber at the time of the development of the specific pulsation such that, during the development of the specific pulsation, within the damping chamber a resonance effect of a Helmholtz resonator occurs.

However, in implementing the device, inclusion of lubricant for the compressor circulating in the refrigerant circulation may occur. The device, consequently, represents an oil trap, wherein the lubricant collected in the resonator volume affects the resonance behaviour of the device.

Conventional devices for reducing the pressure pulsation of a compressor only open and close exclusively when reaching a certain limit value of the mass flow depending on the damper properties, such as a spring constant and the dimensions of an end face, in order to decrease fluctuations of the mass flow and pressure peaks associated therewith, in particular during operation of the compressor with low and minimal loads. Providing a damper with variable volume leads during the operation of the compressor to varying damping behaviour which deviates from the target frequency range and thus cannot effect a decrease of the pulsation. A Helmholtz resonator is based on an active principle with a side volume through which there is no flow and, moreover, requires additional installation space.

U.S. Pat. No. 6,257,848 B1 discloses a compressor for compressing a gaseous fluid with a control valve developed in a suction passage. The control valve is developed for controlling an open area of the suction passage, in particular a flow cross section, which is provided for supplying the gaseous fluid into the compressor. In a first state, in which the gaseous fluid has a low mass flow to be conveyed through the flow cross section of the suction passage, the flow cross section is reduced. On the other hand, in a second state, in which the gaseous fluid has a high mass flow to be conveyed through the flow cross section of the suction passage, the flow cross section is enlarged. The compressor comprises furthermore a suction chamber connected to the suction passage, an inlet opening and a valve chamber developed between the suction passage and the inlet opening. The control valve is disposed movably in the valve chamber. A bypass is additionally implemented between the valve chamber and the suction chamber.

The chambers and flow channels, in particular the flow cross sections of the openings and of the bypass, are herein not tuned to specific frequency ranges in order to effect in these frequency ranges a specific propagation loss and consequently a damping effect. Specifically, due to the distinct length of the flow path through the bypass, an enormous pressure drop occurs which effects a reduction of the compressor performance.

The invention addresses the problem of providing a compressor with a device for damping pressure pulsations which, independent of a limit value of the mass flow, is tuned to specific frequency ranges in which a specific propagation loss occurs and consequently a specific damping effect is produced without the compressor performance being herein significantly affected. The pressure losses are to be minimal. With the damping of the pressure pulsations other noise emissions, inter alia, are to be avoided which affect the comfort, for example the comfort of passengers of a passenger compartment, and the service life of the compressor is to be maximized. The compressor is to be of simple structure built of a minimal number of components with minimal installation space requirement. In addition, the expenditures for the production, the maintenance, the assembly and the operation are to be minimal.

The problem is resolved through the subject matters with the characteristics of the invention described herein.

The problem is resolved through a device according to the invention for damping pressure pulsations for application in the compressor of a gaseous fluid, in particular of a refrigerant. The device comprises a housing, a piston element and a spring element. The housing is developed such that it encompasses a chamber, and includes an inlet opening and an outlet opening. The piston element is disposed within the chamber dividing the chamber into a first chamber volume and a second chamber volume, as well as in such manner that it is movable in a direction of motion between a first end position and a second end position such that the motion of the piston element controls the chamber volumes and a flow cross section of the outlet opening. With the motion of the piston element the magnitudes or dimensions of the chamber volumes and of the flow cross section of the outlet opening are varied. The piston element is supported such that it is stayed on the housing across the spring element.

According to the concept of the invention, the piston element is implemented as a hollow cylinder with two, at least partially closed, end faces. The piston element comprises herein at least one through-opening developed as a fluidic connection between a chamber volume and a volume encompassed by a wall of the piston element.

The surface shell of the piston element is advantageously closed over the entire area. The shell surface is alternatively sealed by means of the wall of the device housing.

According to an advantageous implementation of the invention, each end face of the piston element is developed with at least one through-opening.

According to a preferred embodiment of the invention, the piston element has the form of a circular cylinder. The through-openings, preferably provided in the end faces, are advantageously each developed as openings having a circular cross section.

According to a further development of the invention, the piston element having the form of a circular cylinder with the through-openings of circular cross section provided in the end faces is laid out according to the following formula:

$$D_{TL} = 10\log\left(\frac{(\sigma_A + \sigma_E)^2\cos^2(kL) + (1 + \sigma_A\sigma_E)^2\sin^2(kL)}{4\sigma_A\sigma_E}\right)$$

$$\text{with } \sigma_A = \frac{S}{S_A} \text{ and } \sigma_E = \frac{S}{S_E} \text{ and } k = \frac{w}{c} = \frac{2\pi}{\lambda}.$$

(Source: M. L. Munjal, *Acoustics of Ducts and Mufflers*, New York: Wiley-Interscience; 1987), Herein $D_{TL}$ equates to a transmission loss of the piston element, and consequently to the damping in the closed state of the flow cross section of the outlet opening, L to a length of an inner volume of the piston element, S to a cross sectional area of the inner volume of the piston element and $S_E$ to a cross sectional area of a through-opening for the flow into the piston element and $S_A$ to a cross sectional area of a through-opening for the outflow from the piston element.

With the integration of the device into the compressor as well as with a specific layout of the same, in particular of the defined fixed volume of the piston element as well as of the through-openings, pressure pulsations of the compressor, specifically at selective interference frequencies, are damped.

A further advantageous embodiment of the invention comprises that the inlet opening is implemented in a wall closing off the chamber at a first end face. The outlet opening can be provided in a wall closing off the chamber on a laterals face, in particular on a shell surface.

The direction of motion of the piston element is advantageously directed along a longitudinal axis of the cylinder-shaped piston element. A first end face of the piston element is preferably disposed such that it is oriented toward the inlet opening of the device.

A further advantage of the invention comprises that the spring element is implemented as a helical spring, in particular as a compression spring. The spring element is herein disposed with a longitudinal axis on a longitudinal axis of the piston element.

A first end of the spring element is advantageously disposed in contact on a wall closing off the chamber on a second end face. A second end, developed distally with respect to the first end, of the spring element is preferably oriented in the direction toward the inlet opening and disposed such that it is in contact on an outer side of the piston element, in particular on a second end face of the piston element.

According to a further preferred embodiment of the invention, the piston element in the first end position is disposed at a minimal distance from the inlet opening such that the flow cross section of the outlet opening is closed as well as in such manner that the first chamber volume has a minimal value and such that the second chamber volume has a maximal value. The direct flow path between the inlet opening and the outlet opening of the device is closed.

In the second end position the piston element is advantageously disposed at a maximal distance from the inlet opening such that the flow cross section of the outlet opening is completely opened as well as the first chamber volume having a maximal value and the second chamber volume having a minimal value. The direct flow path between the inlet opening and the outlet opening of the device is completely clear.

The outlet opening of the device is preferably connected with a suction region of the compressor. The device is intended for electrically driven as well as also for mechanically driven compressors.

The inlet opening is advantageously developed as a connection to a low-pressure side of a refrigerant circulation.

The device according to the invention for damping pressure pulsations is preferably employed in a refrigerant compressor of a refrigerant circulation, in particular of an air conditioning system of a motor vehicle.

In summary, the device according to the invention for damping pressure pulsations for application hi a compressor comprises diverse advantages:

- application of a specially tuned reflection sound absorber as the damping element instead of a Helmholtz resonator,
- reduction of pressure pulsations which, independently of a limit value of the conveyed mass flow, are tuned to certain frequency ranges, thereby
- in a wide range of a mass flow to be conveyed, in which the device can be closed and act as a reflection sound absorber, by means of the spring element a specific propagation loss and a specific damping effect are also effected in order to reduce the pressure pulsation, minimal pressure losses due to short flow paths through the device as well as minimal impact on the performance of the compressor to be accepted during operation, avoidance of noise emissions which affect the comfort, for example the comfort of passengers of a passenger compartment, maximal service life, simple structure of a minimal number of components at minimal space requirement, thereby piston elements with conventional dimensions employable, as well as minimal costs for production, assembly and operation.

Further details, characteristics and advantages of embodiments of the invention are evident based on the following description of embodiment examples with reference to the associated drawing.

DETAILED DESCRIPTION

Figure 1A:
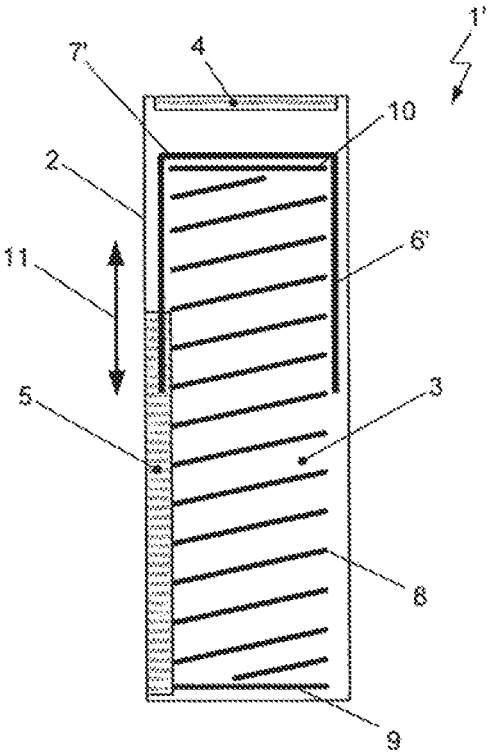
PRIOR ART Fig. 1A
FIG. 1A: a prior art device for damping pressure pulsations for a compressor within a chamber encompassed by a housing in sectional representation in the closed state, as well as FIG. 1B: according to FIG. 1A in an opened state.
Figure 1B:
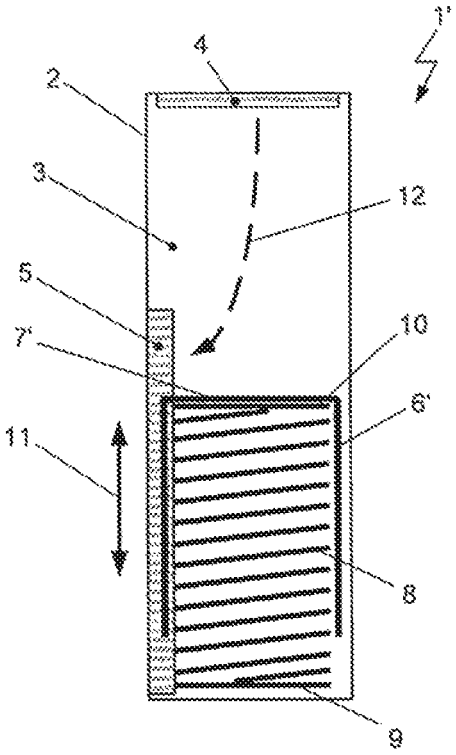
PRIOR ART Fig. 1B

In FIGS. 1A and 1B is shown a device 1' of prior art for damping pressure pulsations for a compressor within a chamber 3 encompassed by a housing 2 in sectional representation. In FIG. 1A the device 1' is shown in a closed state, while the device 1' according to FIG. 1B is shown in an opened state.

The housing 2 encompassing the chamber 3 comprises an inlet opening 4 as well as an outlet opening 5, each of which being implemented in the wall of the housing 2. The fluid to be compressed during its flow through the compressor flows through the inlet opening 4 into the chamber 3 and out of the chamber 3 through the outlet opening 5. The inlet opening 4 is developed as a connection to a low-pressure side of a refrigerant circulation, while the outlet opening 5 is connected with a suction region of the compressor. The inlet opening 4 is implemented in a wall closing off the chamber 3 at a first end face, while the outlet opening 5 is implemented on a wall closing off the chamber 3 at a lateral face.

Within the chamber 3 a piston element 6' is disposed such that it is movable within the chamber 3 in a direction of motion 11. The direction of motion 11 is herein oriented along a longitudinal axis of the cylinder-shaped piston element 6'. With its motion in the direction of motion 11 the piston element 6' controls an open flow cross section of the outlet opening 5, The flow cross section of outlet opening 5 is maximally opened when the piston element 6' in the direction of motion 11 has a maximal distance from the inlet opening 4. The flow cross section of the outlet opening 5 is closed when the piston element 6' in the direction of motion 11 is disposed at a minimal distance from the inlet opening 4. The wall of housing 2 corresponds to the outer form and the outer dimensions of the piston element 6'.

The piston element 6' is supported such that it is stayed on the housing 2 across a spring element 8. The spring element 8 can herein be implemented as a helical spring, in particular as a compression spring, or be implemented of plate springs. A first end 9 of the helical spring-shaped spring element 8 is disposed in contact on a wall closing off the chamber 3 at a second end face. A second end 10, distal with respect to the first end 9, of the spring element 8 is oriented in the direction toward the inlet opening 4. With a region associated with the second end 10, the spring element 8 projects into the piston element 6' and is in contact on an inner surface of an end face 7' on the piston element 6'. The spring element 8 is disposed with a longitudinal axis on the longitudinal axis of piston element 6'. The longitudinal axes of the piston element 6' and of the spring element 8 are disposed congruently.

Piston element 6' is developed as a hollow circular cylinder with a closed end face 7'. Spring element 8 is disposed within the volume encompassed by the hollow circular cylinder, wherein the spring element 8, depending on its state, which means in the non-stressed, and therewith deflected, state or stressed, and consequently compressed state, is integrated with variable proportion within the volume encompassed by the hollow circular cylinder.

The spring element 8 is disposed correspondingly with the piston element 6' such that the piston element 6' in an at least nearly non-stressed state of the spring element 8 closes a flow path between the inlet opening 4 and the outlet opening 5. The piston element 6' is disposed such that it closes the device 1' according to FIG. 1A.

However, the piston element 6' comprises on the shell surface indentations, not shown, as bypasses for the fluid in order to be able to conduct even in the closed state of device 1' at least a minimal mass flow of the fluid through the device 1' or past the device 1'.

In the stressed state of the spring element 8 the piston element 6' opens up a flow path between the inlet opening 4 and the outlet opening 5 such that a fluid to be compressed, for example a refrigerant circulating in a refrigerant circulation, flows in the direction of flow 12 through the chamber 3 of the device 1'. The piston element 6' of the device 1' is displaced, depending on the mass flow conveyed by the compressor, in the direction of motion 11 and positioned depending on the ensuing equilibrium of forces.

The device 1' according to FIG. 1B is opened. In the case of the opened device 1' the piston element 6 moves in the direction of motion 11 away from the inlet opening 4 and opens up at least portions of the flow cross section of the outlet opening 5 such that fluid can flow through the free flow cross section as a variable proportion of the outlet opening 5 out of the chamber 3. With the outlet opening 5 opened a high mass flow of the fluid can flow through the device 1'. In the stationary state, which means at constant pressure and constant mass flow, and therewith at a consistent equilibrium of forces, the position of the piston element 6' also remains unchanged.

At a large mass flow to be conveyed of the fluid to be compressed the pressure loss within the suction region, developed downstream of the outlet opening 5 in the direction of flow, of the compressor is greater than in the proximity of the inlet opening 4. The pressure difference occurring herein causes a pressure force acting onto the surface area of the end face 7' of the piston element 6', which acting pressure force moves the piston element 6' away from the inlet opening 4, With the motion of the piston element 6" the flow cross section of the outlet opening 5 is enlarged. With the enlargement of the flow cross section of the outlet opening 5, and therewith the opening of the outlet opening 5, the pressure loss within the suction region, developed succeeding the outlet opening 5 in the direction of flow, of the compressor becomes less so that the pressure difference also becomes less. At a large mass flow to be conveyed of the fluid to be compressed the pressure pulsation is low.

At a low mass flow to be conveyed of the fluid to be compressed the pressure difference between the suction region, developed succeeding the outlet opening 5 in the direction of flow, of the compressor and the region of the inlet opening 4 is low such that the piston element 6' through the prestress force of the spring element 8 is moved in the direction toward the inlet opening 4 whereby the flow cross section of the outlet opening 5 is decreased. At the same time the fluid flows through the indentations, not shown, developed as bypasses on the shell surface of the piston element 6' and the outlet opening 5 into the suction region. With the low mass flow to be conveyed of the fluid to be compressed higher pressure pulsations occur. The pressure pulsations are damped through an abrupt change of the flow cross section between inlet opening 4 and the suction region. The device 1' acts as a sound absorber.

Figure 2A:
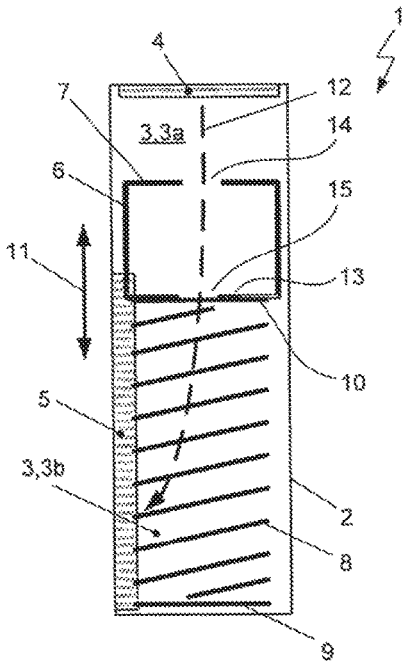
FIG. 2A: a device according to the invention for damping pressure pulsations for a compressor within the chamber encompassed by the housing in sectional representation in a first end position.
Figure 2B:
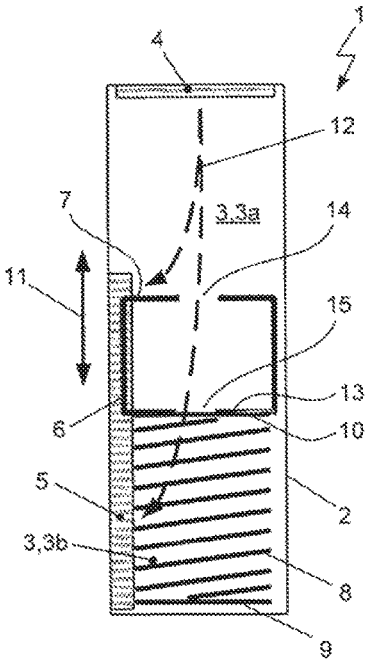
FIG. 2B: according to FIG. 2A in an intermediate position as well as FIG. 2C: according to FIG. 2A in a second end position.
Figure 2C:
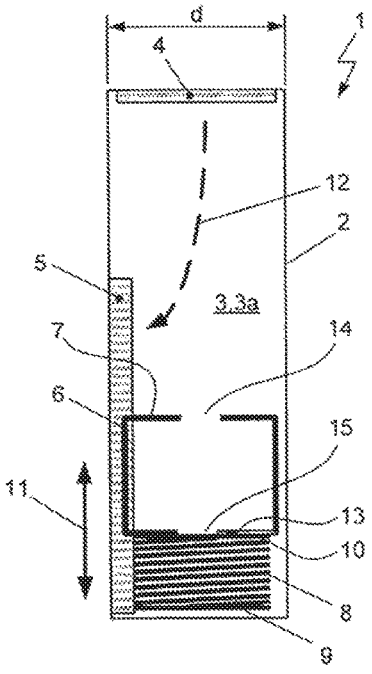

In each of FIG. 2A to 2C a device 1 according to the invention for damping pressure pulsations for a compressor is shown within the chamber 3 encompassed by the housing 2 in sectional representation. In FIG. 2A the device 1 is depicted in a first end position, while the device 1 according to FIG. 2B is shown in its disposition in an intermediate position and in FIG. 20 it is shown in a second end position.

The device 1 according to FIG. 2A to 2C differs from the device 1' from FIGS. 1A and 1B in particular in the implementation of the piston element 6. Identical elements of devices 1, 1' are identified by identical reference numbers.

The chamber 3 is encompassed by housing 2 whose wall comprises an inlet opening 4 as well as an outlet opening 5. The compressor, in particular the device 1, is connected across the inlet opening 4 with the low-pressure side of the refrigerant circulation. The outlet opening 5 establishes the connection to the suction region of the compressor.

With the piston element 6 disposed within the chamber 3 and movable in the direction of motion 11 the chamber 3 is divided, for one, into a first chamber volume 3*a* and a second chamber volume 3*b* as well as, for another, the dimensions of the chamber volumes 3*a*, 3*b* as well as also the flow cross section of the outlet opening 5 are controlled, Herein a first end face 7 of piston element 6 is oriented toward the inlet opening 4.

In a first end position according to FIG. 2A the piston element 6 is positioned at a minimal distance from the inlet opening 4, the flow cross section of the outlet opening 5 is closed, the first chamber volume 3*a* is minimal, while the second chamber volume 3*b* has maximal value. The flow cross section of the outlet opening 5 and the first chamber volume 3*a* have each, in a second end position according to FIG. 20, maximal values since the piston element 6 is disposed at a maximal distance from the inlet opening 4. The second chamber volume 3*b* is minimal.

Between the piston element 6 and the wall of housing 2 is disposed the spring element 8 implemented, for example, as a helical spring, in particular as a compression spring. The first end 9 of the spring element 8 is herein in contact on the end wall of housing 2, while the second end 10, implemented distally to the first end 9, of spring element 8 is oriented in the direction toward the inlet opening 4 and disposed in contact on a second end face 13 of piston element 6.

Piston element 6 is developed as a hollow circular cylinder with two, at least partially closed, end faces 7, 13, which are disposed at ends, distal with respect to each other, of the shell surface of the hollow circular cylinder. The shell surface of piston element 6 is closed over its entire surface, while in each end face 7, 13 at least one through-opening 14, 15 is provided for the fluid to be compressed. The through-openings 14, 15 of end faces 7, 13 of piston element 6 establish each a fluidic connection of the environment of the piston element 6, in particular of chamber 3, with the volume encompassed by the wall of the hollow circular cylinder-shaped piston element 6.

In the first end position, and therewith in an at least nearly non-stressed state of spring element 8 according to FIG. 2A, the piston element 6 is disposed such that it closes off a direct flow path developed between the inlet opening 4 and the outlet opening 5. The fluid introduced through the inlet opening 4 into the first chamber volume 3*a* flows in the direction of flow 12 exclusively through the through-opening 14, developed in the first end face 7 of piston element 6, into the interior of the piston element 6 as well as through the through-opening 15, developed in the second end face 13, out again of the piston element 6 into the second chamber volume 3*b* and is subsequently conducted through the outlet opening 5 into the suction region of the compressor. The device 1 is closed.

In an intermediate state piston element 6, and therewith in a partially stressed state of spring element 8 according to FIG. 2B, the piston element 6 clears a portion of the flow cross section of outlet opening 5, which means it clears a direct flow path between the inlet opening 4 and the outlet opening 5. The fluid to be compressed, for example the refrigerant circulating in the refrigerant circulation, flows in the direction of flow 12 into the first chamber volume 3*a* of device 1. During its flow through the first chamber volume 3*a* the mass flow of the fluid is divided into a first mass subflow and a second mass subflow, with the first mass subflow being conducted through the first chamber volume 3*a*, along the direct flow path through the free flow cross section of outlet opening 5 into the suction region of the compressor, while the second mass subflow is conducted through the through-opening 14, developed in the first end face 7 of piston element 6, into the interior of piston element 6 as well as through the through-opening 15, developed in the second end face 13, into the second chamber volume 3*b* as well as subsequently through the outlet opening 5 into the suction region of the compressor. In the suction region the mass subflows are again mixed with one another.

In the second end position, and therewith in a stressed state of spring element 8, according to FIG. 2C the piston element 6 is disposed such that it clears at least to a large extent the direct flow path developed between the inlet opening 4 and the outlet opening 5. The fluid conducted through the inlet opening 4 into chamber 3 flows in the direction of flow 12 through the first chamber volume 3*a*, along the direct flow path through the free flow cross section of outlet opening 5 into the suction region of the compressor. Device 1, in particular the outlet opening 5, is opened such that a high mass flow of the fluid can flow through the device 1.

In the case of device 1 acting as a sound absorber, the pressure pulsations are also damped through an abrupt change of the flow cross section between the inlet opening 4 and the suction region. The damping effect occurs primarily in operating states with a low mass flow to be conveyed, and therewith at a low load of the compressor, which are to be seen as highly critical with respect to pressure pulsations in the motor vehicle, as well as at closed device 1.

With closed or nearly closed device 1, such as in the case of configurations in the first end position according to FIG. 2A or in an intermediate position according to FIG. 2B, the fluid flows to a large proportion through the through-openings 14, 15, and therewith through the piston element 6, wherein the transmission-loss performance is increased, which damps the pressure pulsations that are propagated from the suction opening of the compressor into the refrigerant line of the refrigerant circulation. The noise emissions or their propagation into the passenger compartment are prevented.

Device 1 is herein preferably disposed on the suction side of the compressor, but alternatively could also be implemented on the pressure side of the compressor.

Through the piston element 6, integrated in the device 1 as a reflection damper with defined volume, the pressure pulsations with the consideration of available installation space limitations are specifically and selectively decreased in a predetermined frequency range.

The piston element 6 can, for example, be implemented of Teflon.

Figure 3A:
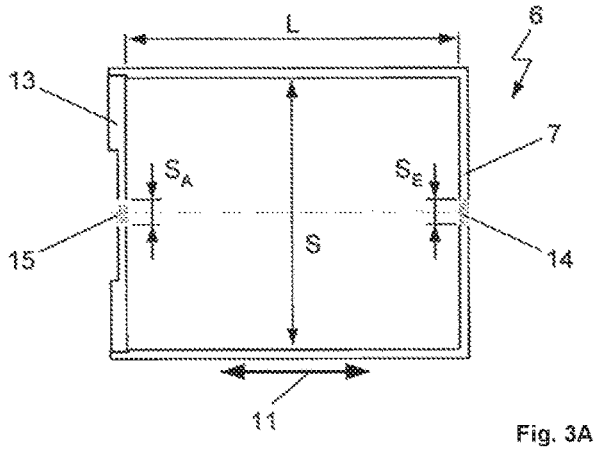
FIG. 3A: a piston element of a device according to the invention for damping pressure pulsations for a compressor in sectional representation.
Figure 3B:
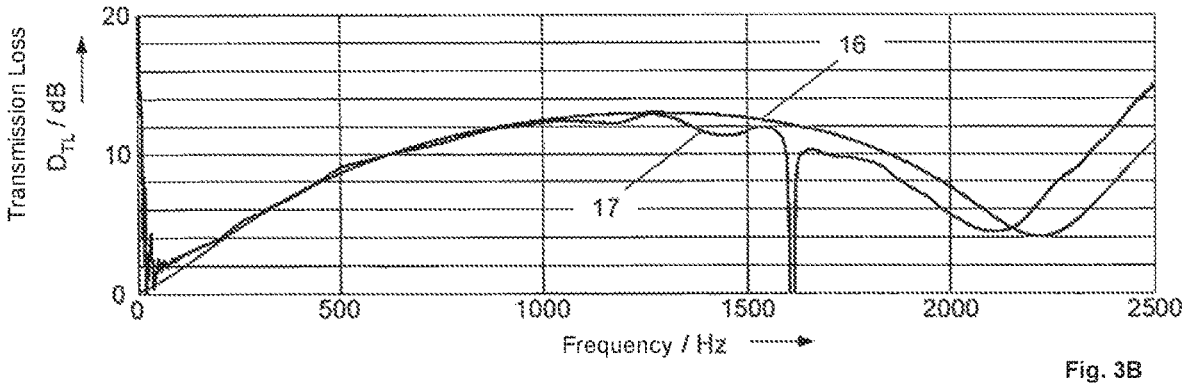
FIG. 3B: transmission losses depending on the frequency based on simulation calculations and measurements for a specific device according to the invention.

In FIG. 3A is shown in sectional representation a piston element 6 of a device 1 according to the invention for damping pressure pulsations for a compressor. In FIG. 3B are depicted transmission losses as a function of the frequency based on simulation calculations and measurements for a device 1 with a certain piston element 6.

Depending on the frequency to be damped and the available installation space, the integrated piston element 6 is laid out by means of the following formula (Source: Munjal, M. L. *Acoustics of Ducts and Mufflers*, New York: Wiley-Interscience, 1987):

$$D_{TL} = 10\log\left(\frac{(\sigma_A + \sigma_E)^2\cos^2(kL) + (1 + \sigma_A\sigma_E)^2\sin^2(kL)}{4\sigma_A\sigma_E}\right)$$

$$\text{with } \sigma_A = \frac{S}{S_A} \text{ and } \sigma_E = \frac{S}{S_E} \text{ and } k = \frac{w}{c} = \frac{2\pi}{\lambda}.$$

The available installation space is given by the inner diameter d of chamber 3 according to FIG. 2C. $D_{TL}$ equates to the transmission loss of the piston element 6 and consequently to the damping in the closed state of the flow cross section of outlet opening 5. The inner volume of the hollow cylinder-shaped piston element 6 is defined on the basis of the length L as well as the cross sectional area S. Herein are $S_E$ the cross sectional area of the through-opening 14 for the inflow into the piston element 6 and $S_A$ the cross sectional area of the through-opening 15 for the outflow from piston element 6.

The formula for the transmission loss $D_{TL}$ as a measure of the reduction of the pressure pulsations applies in particular for the closed piston element 6 with the through-openings 14, 15 in the particular end faces. Through the piston element 6 with the two through-openings 14, 15 the pressure pulsations experience a reduction at the level of the transmission loss $D_{TL}$.

In FIG. 3B the simulation values 16, which means the values obtained from simulation calculation, and the associated measurement values 17 of device 1 are compared.

With increased stress of spring element 8 the piston element 6 can, during operation with low mass flows, be maintained in the first end position according to FIG. 2A, which requires an intentional objective-oriented layout.

The closed piston element 6, only developed with the two through-openings 14, 15, acts as a reflection sound absorber in order to increase the pressure pulsation damping performance. The improved propagation loss of the device 1 effects herein no noticeable change of the conveyed mass flow.

The invention claimed is:

1. A device for damping pressure pulsations for a compressor of a gaseous fluid comprising:

a housing that encompasses a chamber and is implemented with an inlet opening and an outlet opening, a piston element which within the chamber divides the chamber into a first chamber volume and a second chamber volume, as well as being disposed movably in a direction of motion between a first end position and a second end position, wherein the motion of the piston element controls the size of both chamber volumes and a flow cross section of the outlet opening, as well as being supported stayed on the housing across a spring element, wherein the piston element includes:

a side wall closing a lateral area of the piston element over the entire surface of the side wall, a first end wall partially closing one end of the piston element, a second end wall at least partially closing the other end of the piston element, and a volume encompassed by the side wall, the first end wall and the second end wall, wherein the first end wall includes a first through opening formed as a fluidic connection between the first chamber volume and the volume of the piston element, and wherein the second end wall includes a second through opening formed as a fluidic connection between the second chamber volume and the volume of the piston element;

wherein the gaseous fluid is a refrigerant.

2. The device according to claim 1, wherein the piston element is formed as a circular cylinder.

3. The device according to claim 2, wherein the volume of the piston element is an inner volume, and the piston element has a transmission loss according to the formula:

$$D_{TL} = 10\log\left(\frac{(\sigma_A + \sigma_E)^2\cos^2(kL) + (1 + \sigma_A\sigma_E)^2\sin^2(kL)}{4\sigma_A\sigma_E}\right)$$

$$\text{with } \sigma_A = \frac{S}{S_A} \text{ and } \sigma_E = \frac{S}{S_E} \text{ and } k = \frac{w}{c} = \frac{2\pi}{\lambda}.$$

wherein $D_{TL}$ is the transmission loss of the piston element, L is a length of the inner volume of the piston element, S is a cross sectional area of the inner volume of piston element, $S_E$ is a cross sectional area of the first through-opening for inflow of the refrigerant into the piston element and $S_A$ is a cross sectional area of the second through-opening for outflow of the refrigerant from the piston element.

4. The device according to claim 1, wherein the inlet opening is developed in a wall of the chamber at a first end face.

5. The device according to claim 1, wherein the piston element is formed as a circular-shaped piston element and the direction of motion is oriented along a longitudinal axis of the cylinder-shaped piston element.

6. The device according to claim 1, wherein a first end face of the piston element is disposed such that it is oriented toward the inlet opening.

7. The device according to claim 1, wherein the spring element is developed as a helical spring.

8. The device as in claim 7, wherein the spring element is disposed with a longitudinal axis on a longitudinal axis of the piston element.

9. The device as in claim 7, wherein a first end of the spring element is disposed such that it is in contact with a wall closing off the chamber at a second end face.

10. The device according to claim 7, wherein a second end, developed distally to a first end of the spring element, is oriented in the direction toward the inlet opening and is disposed such that it is in contact with an outer side of the piston element.

11. The device as in claim 10, wherein the second end of the spring element is disposed such that it is in contact with the second end wall of the piston element.

12. The device according to claim 1, wherein the piston element in the first end position is disposed at a minimal distance from the inlet opening such that the flow cross section of the outlet opening is closed and the size of the first chamber volume has a minimal value and the size of the second chamber volume has a maximal value.

13. The device according to claim 1, wherein the piston element in the second end position is disposed at a maximal distance from the inlet opening such that the flow cross section of the outlet opening is completely opened and the size of the first chamber volume has a maximal value and the size of the second chamber volume has a minimal value.

14. The device according to claim 1, wherein the outlet opening is connected with a suction region of the compressor.

15. A method for cooling a motor vehicle with a refrigerant compressor having a device for damping pressure pulsations of a refrigerant, the device comprising:

a housing that encompasses a chamber and is implemented with an inlet opening and an outlet opening, a piston element which within the chamber divides the chamber into a first chamber volume and a second chamber volume, as well as being disposed movably in a direction of motion between a first end position and a second end position, wherein the motion of the piston element controls the size of both chamber volumes and a flow cross section of the outlet opening, as well as being supported stayed on the housing across a spring element, wherein the piston element includes:

a side wall closing a lateral area of the piston element over the entire surface of the side wall, a first end wall partially closing one end of the piston element, a second end wall partially closing the other end of the piston element, and a volume encompassed by the side wall, the first end wall and the second end wall, wherein the first end wall includes a first through opening formed as a fluidic connection between the first chamber volume and the volume of the piston element, and wherein the second end wall includes a second through opening formed as a fluidic connection between the second chamber volume and the volume of the piston element, the method comprising the step of operating the refrigerant compressor having the device to cool the motor vehicle.

* * * * *